US008834242B2

(12) United States Patent
Uenaka et al.

(10) Patent No.: US 8,834,242 B2
(45) Date of Patent: Sep. 16, 2014

(54) CEILING-EMBEDDED TYPE AIR CONDITIONER, AND A CONTROL METHOD THEREOF

(75) Inventors: Shunichi Uenaka, Sakai (JP); Shingo Onishi, Sakai (JP); Yukio Inoue, Sakai (JP); Tsunehisa Sanagi, Sakai (JP); Azumi Terakawa, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 1252 days.

(21) Appl. No.: 10/571,553

(22) PCT Filed: Jan. 17, 2005

(86) PCT No.: PCT/JP2005/000457

§ 371 (c)(1),
(2), (4) Date: Mar. 10, 2006

(87) PCT Pub. No.: WO2005/069745

PCT Pub. Date: Aug. 4, 2005

(65) Prior Publication Data

US 2008/0254734 A1 Oct. 16, 2008

(30) Foreign Application Priority Data

Jan. 26, 2004 (JP) ..... 2004-017197

(51) Int. Cl.
*F24F 7/007* (2006.01)
*F24F 1/00* (2011.01)
*F24F 13/06* (2006.01)

(52) U.S. Cl.
CPC ..... *F24F 1/0011* (2013.01); *F24F 2013/0616* (2013.01); *F24F 1/007* (2013.01); *F24F 2001/0037* (2013.01)
USPC ..... 454/254

(58) Field of Classification Search
USPC ..... 454/254
See application file for complete search history.

(56) References Cited

U.S. PATENT DOCUMENTS

| | | | | |
|---|---|---|---|---|
| 4,729,293 | A * | 3/1988 | Tsunoda et al. | 454/313 |
| 4,782,999 | A | 11/1988 | Ishii et al. | |
| 5,242,325 | A | 9/1993 | Nukushina | |
| 5,775,989 | A | 7/1998 | Choi | |
| 5,924,923 | A * | 7/1999 | Chiguchi et al. | 454/256 |

(Continued)

FOREIGN PATENT DOCUMENTS

| | | |
|---|---|---|
| EP | 1 316 760 A1 | 6/2003 |
| EP | 1 380 797 A1 | 1/2004 |
| JP | 2003-269776 | 9/2003 |

OTHER PUBLICATIONS

Supplementary European Search Report dated Apr. 15, 2010 of corresponding European Application No. 05 70 3695.6.

*Primary Examiner* — Kang Hu
*Assistant Examiner* — Samantha Miller
(74) *Attorney, Agent, or Firm* — Global IP Counselors

(57) ABSTRACT

A ceiling embedded type air conditioner is embedded in a ceiling surface and includes an outlet that blows out air conditioned air toward an indoor space, and a louver capable of changing a blow-out vertical direction of the air conditioned air at the outlet. If a state in which a wind direction position of the louver is set so that it is oriented to a wind direction position continues for a first prescribed time or longer, then the louver is temporarily changed to a wind direction position more downward than the wind direction position, and once again changed to the wind direction position.

18 Claims, 6 Drawing Sheets

(56) References Cited

U.S. PATENT DOCUMENTS 5,934,783 A * 8/1999 Yoshikawa ..... 362/96
6,142,108 A * 11/2000 Blichmann ..... 123/41.05
6,685,556 B1 * 2/2004 Bertin ..... 454/256

* cited by examiner

CEILING-EMBEDDED TYPE AIR CONDITIONER, AND A CONTROL METHOD THEREOF

CROSS-REFERENCE TO RELATED APPLICATIONS

This U.S. National stage application claims priority under 35 U.S.C. §119(a) to Japanese Patent Application No. 2004-017197, filed in Japan on Jan. 26, 2004 the entire contents of which are hereby incorporated herein by reference.

FIELD OF THE INVENTION

The present invention relates to an air conditioner, and a control method thereof, and more particularly relates to a ceiling embedded type air conditioner, and a control method thereof, embedded in a ceiling surface and comprising an outlet that blows out air conditioned air toward an indoor space, wherein the outlet comprises a guiding means capable of changing the vertical direction of the air conditioned air that is blown out.

BACKGROUND ART

In a conventional ceiling embedded type air conditioner, which is disposed so that it is embedded in a ceiling surface, an outlet that blows out air conditioned air toward the indoor space is provided with a louver, which serves as a guiding means capable of changing the blow-out vertical direction of the air conditioned air. Furthermore, the blow-out vertical direction of the air conditioned air is changed to uniformize the temperature distribution of the indoor space, thereby achieving a satisfactory airflow distribution of the indoor space by executing control, such as: continuously swinging the louver to continuously change the blow-out vertical direction of the air conditioned air to the vertical direction; setting the louver so that the blow-out vertical direction of the air conditioned air is downward during heating operation; or setting the louver so that the blow-out vertical direction of the air conditioned air is in the vicinity of substantially the horizontal direction with respect to the ceiling surface (hereinafter, referred to as the horizontal blow-out state) during cooling operation.

If the louver is set to the horizontal blow-out state, then the air conditioned air blown out from the outlet flows so that it clings to the ceiling surface due to the Coanda effect; consequently, even if the louver is changed so that the air conditioned air transitions slightly downward from the ceiling surface clinging state, there is a problem in that the flow of the air conditioned air clinging to the ceiling surface cannot be detached from the ceiling surface, and the blow-out vertical direction of the air conditioned air therefore cannot be changed. Furthermore, there is a problem in that the ceiling surface tends to become stained in places because microgranular dust contained in the air conditioned air blown out from the outlet adheres to the ceiling surface.

In contrast, when changing the louver to another wind direction position (hereinafter, referred to as the target wind direction position), control is executed to downwardly adjust the blow-out vertical direction of the air conditioned air by changing the blow-out vertical direction to a wind direction position that was adjusted to a position more downward than the target wind direction position, thereby detaching from the ceiling surface the flow of the air conditioned air clinging to the ceiling surface due to the Coanda effect, and enabling the blow-out vertical direction of the air conditioned air to be changed. In addition, if the air volume of the air conditioned air is small, then a wide adjustment range is set for the wind direction position at this time (i.e., so that the blow-out vertical direction of the air conditioned air transitions more downwardly) so that a feeling of a draft is not imparted to the room occupants (see, for example, Japanese Patent Publication No. 2003-269776).

SUMMARY OF THE INVENTION

Incidentally, events such as the opening and closing of doors and windows, room occupants walking around, and the like, may affect the airflow distribution of the air conditioned space. Furthermore, if the louver is set to the horizontal blow-out state, the abovementioned events may disturb the airflow distribution of the air conditioned space and may cause the unfortunate effect wherein the flow of the air conditioned air blown out from the outlet clings to the ceiling (hereinafter, referred to as the ceiling airflow clinging effect).

However, with the abovementioned ceiling embedded type air conditioner, the blow-out vertical direction is changed to a wind direction position that was adjusted to a position more downward than the target wind direction position only when changing the louver to another vertical position; therefore, the abovementioned ceiling airflow clinging effect, which might arise even in the state wherein the wind direction position of the louver is fixed, cannot be prevented. Consequently, there still remains the problem in that the ceiling surface tends to become stained in places because microgranular dust contained in the air conditioned air blown out from the outlet adheres to the ceiling surface.

In addition, with the abovementioned ceiling air conditioner, the wind direction position of the louver is unfortunately changed to a wind direction position that was adjusted to a position more downward than the target wind direction position; as a result, the wind direction position is set more downward than the wind direction position set by the user, and the wind direction position set by the user, i.e., the blow-out vertical direction of the air conditioned air, cannot be maintained. Moreover, if the air volume decreases, then the wind direction position is further adjusted downward and unfortunately further deviates from the wind direction position set by the user under operating conditions wherein the air volume is small.

It is an object of the present invention to prevent, with a ceiling embedded type air conditioner, the unfortunate clinging to the ceiling surface of the flow of the air conditioned air blown out from the outlet due to disturbances to the airflow distribution of the air conditioned space, such as the opening of doors and windows.

A ceiling embedded type air conditioner according to a first aspect of the present invention is a ceiling embedded type air conditioner embedded in a ceiling surface, and comprising an outlet that blows out air conditioned air toward an indoor space, and a guiding means that can change the blow-out vertical direction of the air conditioned air at the outlet, wherein if a state, wherein the guiding means is set so that the blow-out vertical direction of the air conditioned air is oriented to a first blow-out direction, continues for a first prescribed time or longer, then the blow-out vertical direction of the air conditioned air is temporarily changed so that it is blown out toward a second blow-out direction more downward than the first blow-out direction, and the blow-out vertical direction of the air conditioned air is once again changed so that it blows out in the first blow-out direction.

With this ceiling embedded type air conditioner, if the state, wherein the guiding means provided at the outlet is set so that the blow-out vertical direction of the air conditioned air is the first blow-out direction, continues for the first prescribed time or longer, then the blow-out vertical direction of the air conditioned air is changed so that the blow-out vertical direction of the air conditioned air is blown out toward the second blow-out direction more downward than the first blow-out direction; consequently, even if the flow of the air conditioned air blown out from the outlet unfortunately clings to the ceiling due to disturbances to the airflow distribution of the air conditioned space, such as the opening of a door or window, it is possible to detach that flow from the ceiling surface. Thereby, it is possible to reduce the time spent in the state wherein the flow of the air conditioned air blown out from the outlet clings to the ceiling, and to reduce staining of the ceiling surface.

Moreover, because the change in the blow-out vertical direction of the air conditioned air to the second blow-out direction is temporary, the blow-out vertical direction of the air conditioned air is changed from the first blow-out direction to the second blow-out direction, and subsequently returned once again so that it blows out toward the first blow-out direction, the blow-out vertical direction of the air conditioned air can be maximally maintained in the first blow-out direction set by the user.

A ceiling embedded type air conditioner according to a second aspect of the present invention is a ceiling embedded type air conditioner as recited in the first aspect of the present invention, wherein when the blow-out vertical direction of the air conditioned air is temporarily changed by the guiding means from the first blow-out direction to the second blow-out direction, the air volume of the air conditioned air is temporarily changed, in a state wherein the guiding means is set so that the blow-out vertical direction of the air conditioned air is oriented to the first blow-out direction, from a first air volume to a second air volume smaller than the first air volume; and when the blow-out vertical direction of the air conditioned air is changed by the guiding means once again from the second blow-out direction to the first blow-out direction, the air volume of the air conditioned air changes once again from the second air volume to the first air volume.

With this ceiling embedded type air conditioner, when the blow-out vertical direction of the air conditioned air is temporarily changed from the first blow-out direction to the second blow-out direction and then changed once again to the first blow-out direction, i.e., when the blow-out vertical direction of the air conditioned air is temporarily set downward, the air volume of the air conditioned air is temporarily reduced from the first air volume to the second air volume, and consequently a feeling of a draft is not imparted to the room occupants.

A ceiling embedded type air conditioner according to a third aspect of the present invention is a ceiling embedded type air conditioner as recited in the second aspect of the present invention, wherein when a second prescribed time has elapsed after an instruction has been given to change the air volume of the air conditioned air from the first air volume to the second air volume, the guiding means changes the blow-out vertical direction of the air conditioned air from the first blow-out direction to the second blow-out direction.

With this ceiling embedded type air conditioner, prior to the guiding means changing the blow-out vertical direction of the air conditioned air from the first blow-out direction to the second blow-out direction, an instruction is executed to change the air volume of the air conditioned air from the first air volume to the second air volume, and waiting for the elapse of just the second prescribed time can at least begin to reduce the air volume, and it is therefore possible to reliably not impart a feeling of a draft to the room occupants.

A ceiling embedded type air conditioner according to a fourth aspect of the present invention is a ceiling embedded type air conditioner as recited in the third aspect of the present invention, wherein after the blow-out vertical direction of the air conditioned air has been changed by the guiding means from the second blow-out direction to the first blow-out direction, the air volume of the air conditioned air changes from the second air volume to the first air volume.

With this ceiling embedded type air conditioner, after the guiding means has returned the blow-out vertical direction of the air conditioned air from the second blow-out direction to the first blow-out direction, it returns the air volume of the air conditioned air from the second air volume to the first air volume, and it is therefore possible to reliably not impart a feeling of a draft to the room occupants.

A ceiling embedded type air conditioner according to a fifth aspect of the present invention is a ceiling embedded type air conditioner as recited in any one of the first through fourth aspects of the present invention, wherein the first blow-out direction is a direction corresponding to the upper limit at which the guiding means can change the blow-out vertical direction of the air conditioned air blown out from the outlet to the indoor space.

With this ceiling embedded type air conditioner, because the first blow-out direction is a direction corresponding to the upper limit by which the blow-out vertical direction of the air conditioned air can be changed, it is possible to reduce the time spent in the state wherein the flow of the air conditioned air blown out from the outlet clings to the ceiling under the conditions that most easily produce the phenomenon wherein the flow of the air conditioned air blown out from the outlet clings to the ceiling surface due to disturbances to the airflow distribution of the air conditioned space, such as the opening of a door or a window, and staining of the ceiling surface can thereby be reduced.

A ceiling embedded type air conditioner according to a sixth aspect of the present invention is a ceiling embedded type air conditioner as recited in any one of the first through fifth aspects of the present invention, wherein the second blow-out direction is a direction corresponding to the lower limit at which the guiding means can change the blow-out vertical direction of the air conditioned air blown out from the outlet to the indoor space.

With this ceiling embedded type air conditioner, the second blow-out direction is the direction corresponding to the lower limit by which the blow-out vertical direction of the air conditioned air can be changed, and, even if the flow of the air conditioned air blown out from the outlet clings to the ceiling surface due to disturbances to the airflow distribution of the air conditioned space, such as the opening of a door or a window, the flow can be reliably detached from the ceiling surface.

A ceiling embedded type air conditioner according to a seventh aspect of the present invention is a ceiling embedded type air conditioner as recited in any one of the second through sixth aspects of the present invention, wherein the second air volume is an air volume corresponding to the lower limit of the variable air volume range of the air conditioned air.

With this ceiling embedded type air conditioner, the second air volume is an air volume that corresponds to the lower limit of the variable air volume range of the air conditioned air, and, when the blow-out vertical direction of the air conditioned air has changed downward, it is possible to sufficiently reduce the air volume and reliably not impart a feeling of a draft to the room occupants. Here, the lower limit of the variable air volume range of the air conditioned air means the lower limit of the air volume that can be set by the user, or the lower limit of the air volume at which the fan, and the like, can operate in order to ventilate the air conditioned air contained in the ceiling embedded type air conditioner.

A ceiling embedded type air conditioner according to an eighth aspect of the present invention is a ceiling embedded type air conditioner as recited in any one of the first through the seventh aspects of the present invention, wherein if an instruction is given to change the blow-out vertical direction of the air conditioned air to a third blow-out direction during the time when the blow-out vertical direction of the air conditioned air is temporarily changed by the guiding means from the first blow-out direction to the second blow-out direction and until it is once again changed to the first blow-out direction, then, after the guiding means has temporarily changed the blow-out vertical direction of the air conditioned air from the first blow-out direction to the second blow-out direction, it changes to the third blow-out direction without changing to first blow-out direction.

With this ceiling embedded type air conditioner, even if an instruction is issued to change the setting of the blow-out vertical direction of the air conditioned air during the time up to when the guiding means temporarily changes the blow-out vertical direction of the air conditioned air from the first blow-out direction to the second blow-out direction and then changes it once again to the first blow-out direction, it goes through the process of changing it from the first blow-out direction to the second blow-out direction, and consequently, even if the flow of the air conditioned air blown out from the outlet clings to the ceiling due to disturbances to the airflow distribution of the air conditioned space, such as the opening of a door or a window, it is possible to reliably detach that flow from the ceiling surface.

Moreover, because it directly changes to the third blow-out direction, which is the target direction in changing the setting of the blow-out vertical direction of the air conditioned air, without returning from the second blow-out direction to the first blow-out direction, it is possible to improve the responsiveness to changing the setting of the blow-out vertical direction of the air conditioned air.

A ceiling embedded type air conditioner according to a ninth aspect of the present invention is a ceiling embedded type air conditioner as recited in any one of the second invention through seventh aspects of the present invention, wherein if an instruction is given to change the air volume of the air conditioned air to a third air volume during the time when the blow-out vertical direction of the air conditioned air is temporarily changed by the guiding means from the first blow-out direction to the second blow-out direction and until it is once again changed to the first blow-out direction, then, after the guiding means has changed the blow-out vertical direction from the second blow-out direction to the first blow-out direction, it changes the air volume of air conditioned air to the third air volume without changing it from the second air volume to the first air volume.

With this ceiling embedded type air conditioner, even if an instruction is issued to change the setting of the air flow of the air conditioned air during the time up to when the guiding means temporarily changes the blow-out vertical direction of the air conditioned air from the first blow-out direction to the second blow-out direction and then changes it once again to the first blow-out direction, it goes through the process of changing it from the first air flow to the second air flow, and consequently it is possible to reliably not impart a feeling of a draft to the room occupants.

Moreover, because it directly changes to the third air flow, which is the target volume in changing the setting of the air flow of the air conditioned air, without returning from the second air flow to the first air flow, it is possible to improve the responsiveness to changing the setting of the air flow of the air conditioned air.

A method of controlling a ceiling embedded type air conditioner according to a tenth aspect of the present invention is a method of controlling a ceiling embedded type air conditioner embedded in a ceiling surface, and comprising an outlet that blows out air conditioned air toward an indoor space, and a guiding means that can change the blow-out vertical direction of the air conditioned air at the outlet, wherein if a state, wherein the guiding means is set so that the blow-out vertical direction of the air conditioned air is oriented to a first blow-out direction, continues for a first prescribed time or longer, then the blow-out vertical direction of the air conditioned air is temporarily changed so that it is blown out toward a second blow-out direction more downward than the first blow-out direction, and the blow-out vertical direction of the air conditioned air is once again changed so that it blows out in the first blow-out direction.

With this method of controlling a ceiling embedded type air conditioner, if the state, wherein the guiding means provided at the outlet is set so that the blow-out vertical direction of the air conditioned air is the first blow-out direction, continues for the first prescribed time or longer, then the blow-out vertical direction of the air conditioned air is changed so that the blow-out vertical direction of the air conditioned air is blown out toward the second blow-out direction more downward than the first blow-out direction; consequently, even if the flow of the air conditioned air blown out from the outlet unfortunately clings to the ceiling due to disturbances to the airflow distribution of the air conditioned space, such as the opening of a door or window, it is possible to detach that flow from the ceiling surface. Thereby, it is possible to reduce the time spent in the state wherein the flow of the air conditioned air blown out from the outlet clings to the ceiling, and to reduce staining of the ceiling surface.

Moreover, because the change in the blow-out vertical direction of the air conditioned air to the second blow-out direction is temporary, the blow-out vertical direction of the air conditioned air is changed from the first blow-out direction to the second blow-out direction, and subsequently returned once again so that it blows out toward the first blow-out direction, the blow-out vertical direction of the air conditioned air can be maximally maintained in the first blow-out direction set by the user.

DETAILED DESCRIPTION OF THE PREFERRED EMBODIMENTS

The following explains the embodiments of a ceiling embedded type air conditioner according to the present invention, referencing the drawings.

(1) Constitution of the Air Conditioner

Figure 1:
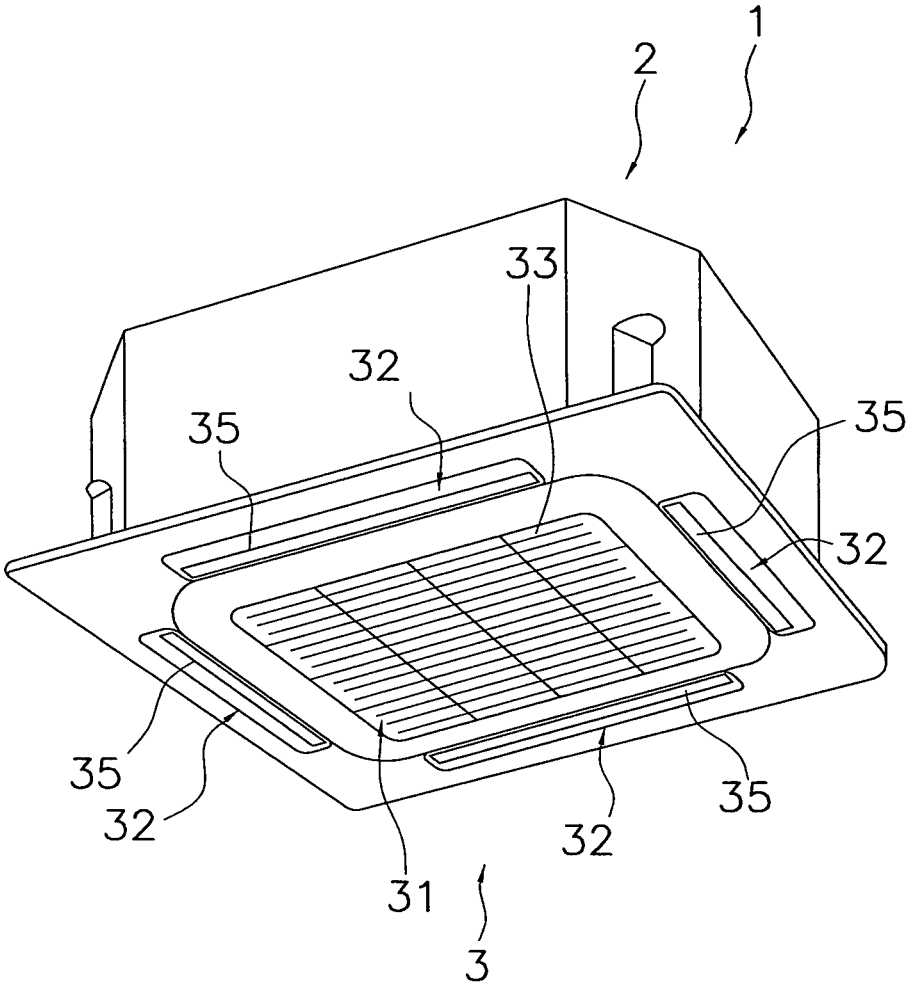
FIG. 1 is an external perspective view of the air conditioner according to one embodiment of the present invention.
Figure 2:
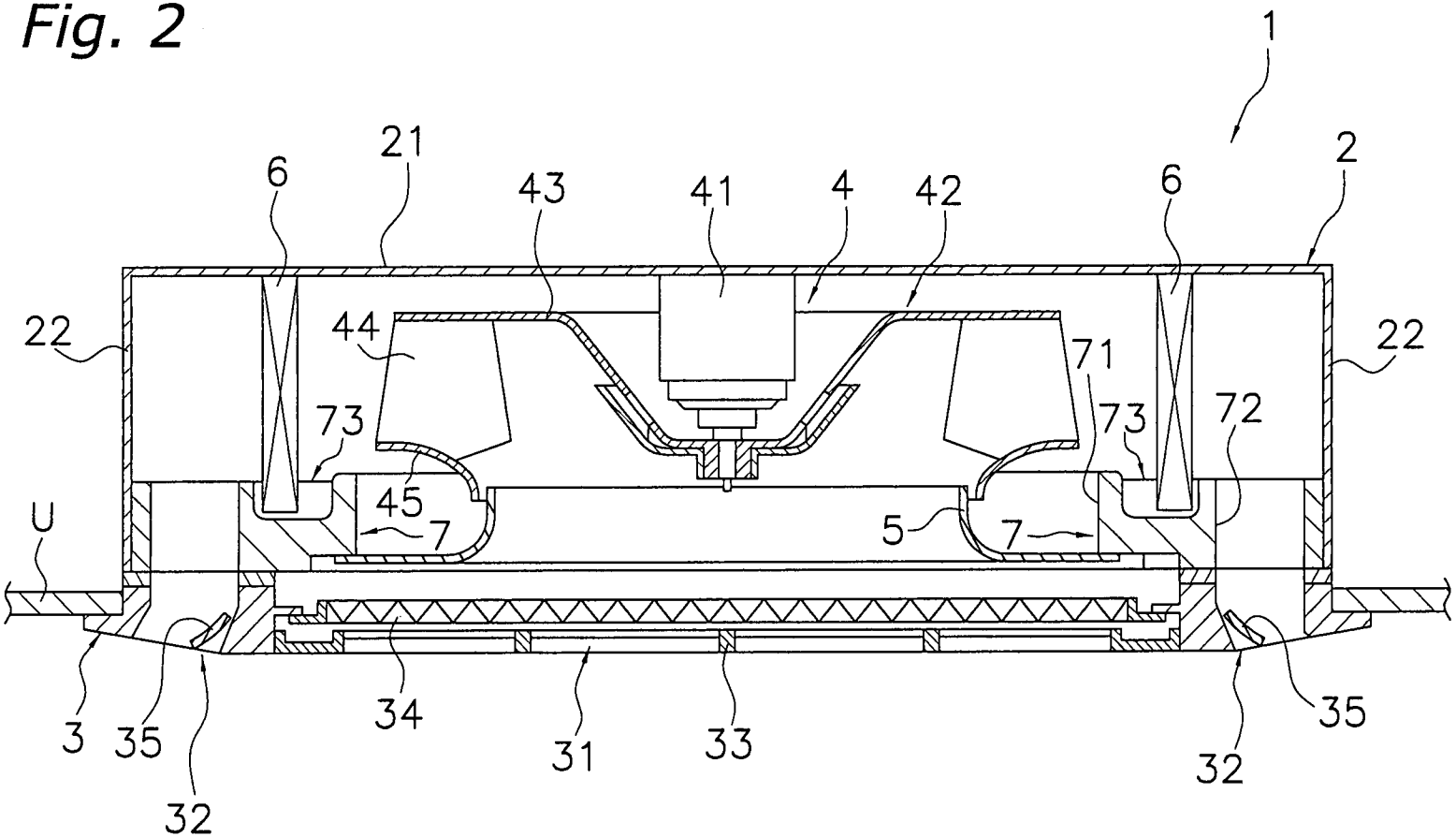
FIG. 2 is a schematic side cross sectional view of the air conditioner.

FIG. 1 is an external perspective view of an air conditioner 1 according to one embodiment of the present invention (the ceiling surface is not shown). The air conditioner 1 is a ceiling embedded type air conditioner comprising a casing 2 that internally houses various constituent equipment and a face panel 3 disposed on the lower side of the casing 2. As shown in FIG. 2, the casing 2 is disposed so that it is inserted into an opening formed in a ceiling surface U of the air conditioned room. Furthermore, the face panel 3 is disposed so that it is fitted into the opening of the ceiling surface U. Here, FIG. 2 is a schematic side cross sectional view of the air conditioner 1.

As shown in FIG. 2, the casing 2 is a box shaped body whose lower surface is open, and comprises a top plate 21, and a side plate 22 extending downward from the circumferential edge part of the top plate 21.

Figure 3:
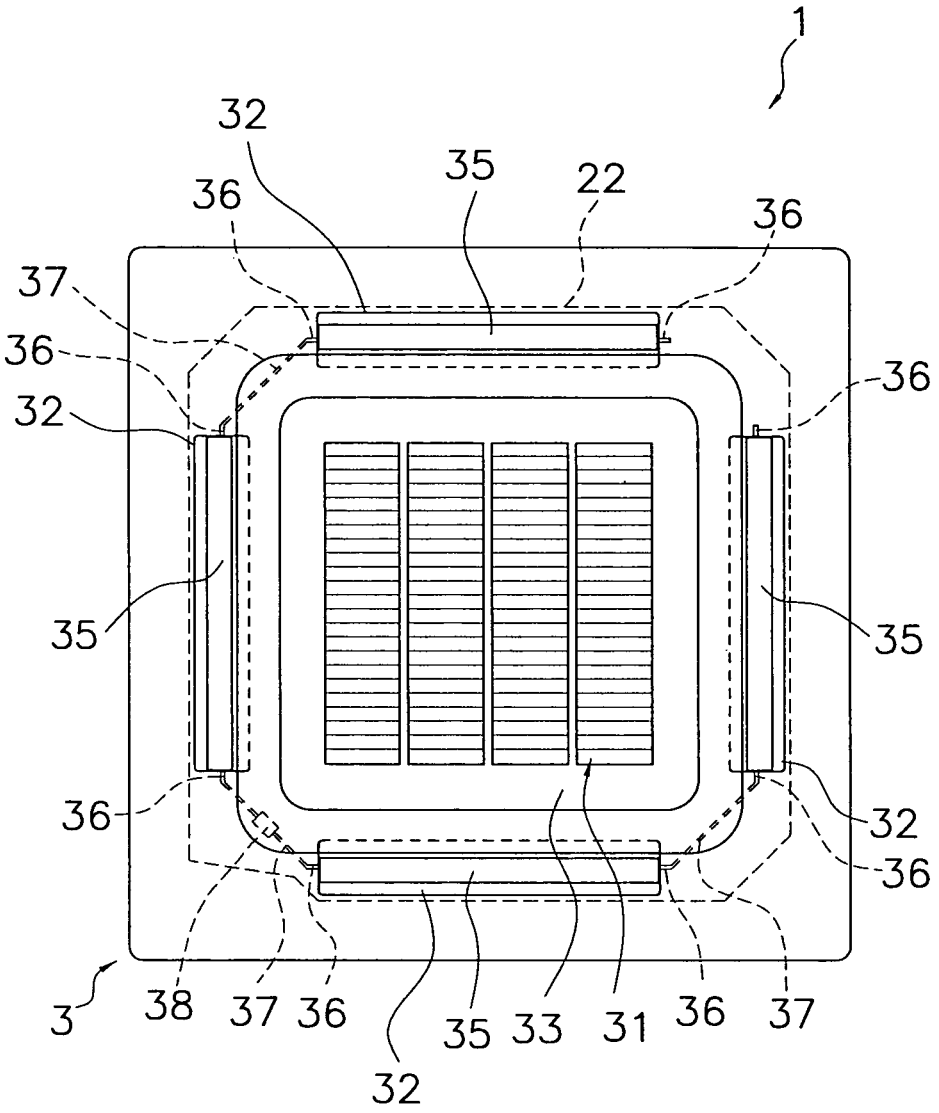
FIG. 3 is a plan view of a face panel of the air conditioner viewed from the indoor space side.

As depicted in FIG. 1 and FIG. 3, the face panel 3 is a plate shaped body fixed to the lower end part of the casing 2 and substantially a quadrilateral in a plan view, and principally comprises at the substantial center thereof an inlet 31 that sucks indoor air into the casing 2, and a plurality (4 in the present embodiment) of outlets 32 that blow the air conditioned air from inside the casing 2 out toward the indoor space. Here, FIG. 3 is a plan view of the face panel 3 of the air conditioner 1 viewed from the indoor space side. The inlet 31 is a substantially square shaped opening in the present embodiment. Each outlet 32 is a substantially rectangular shaped opening that extends elongated along the circumferential edge part of the face panel 3. The inlet 31 is provided with an inlet grill 33, and a filter 34 for eliminating dust in the indoor air sucked in from the inlet 31.

Inside the casing 2 are principally disposed a fan 4 that sucks the indoor air through the inlet 31 of the face panel 3 into the casing 2 and blows it out in the outer circumferential direction, and a heat exchanger 6 disposed so that it surrounds the outer circumference of the fan 4.

The fan 4 is a turbo fan in the present embodiment and comprises a fan motor 41 provided in the center of the top plate 21 of the casing 2, and an impeller 42 linked to and rotatably driven by the fan motor 41. The impeller 42 comprises a disc shaped end plate 43 linked to the fan motor 41, a plurality of blades 44 provided at the outer circumferential part of the lower surface of the end plate 43, and a disc shaped end ring 45, which has an opening at its center, provided on the lower side of the blades 44. The fan 4 can suck the indoor air into the interior of the impeller 42 via the opening of the end ring 45 by the rotation of the blades 44 and can blow it out to the outer circumferential side of the impeller 42.

In the present embodiment, the heat exchanger 6 is a cross finned tube type heat exchanger panel formed by bending it so that it surrounds the outer circumference of the fan 4, and is connected via the refrigerant piping to the outdoor unit (not shown) installed outdoors, and the like. The heat exchanger 6 can function as an evaporator of the refrigerant flowing internally during cooling operation and as a condenser of the refrigerant flowing internally during heating operation. Thereby, the heat exchanger 6 can cool during cooling operation and heat during heating operation the indoor air that was sucked in through the inlet 31 into the casing main body 2 and blown out to the outer circumferential side of the impeller 42 of the fan 4.

A drain pan 7 is disposed on the lower side of the heat exchanger 6 for receiving drain water generated by the condensation of moisture in the indoor air when cooling the indoor air in the heat exchanger 6. The drain pan 7 is attached to the lower part of the casing main body 2.

In the present embodiment, the drain pan 7 comprises an inlet hole 71 formed so that it is in communication with the inlet 31 of the face panel 3, four outlet holes 72 formed so that they are in communication with the outlets 32 of the face panel 3, and a drain water receiving groove 73 that receives the drain water and is formed on the lower side of the heat exchanger 6. Furthermore, the inlet hole 71 comprises the inlet 31 of the face panel 3 and an inlet passageway for sucking the indoor air into the casing 2. In addition, each outlet hole 72 comprises an outlet 32 of the face panel 3 along with an outlet passageway for blowing out into the indoor space the air conditioned air cooled or heated in the heat exchanger 6. In addition, a bell mouth 5 is disposed in the inlet hole 71 of the drain pan 7 for guiding the indoor air sucked in from the inlet 31 to the impeller 42 of the fan 4.

Figure 4:
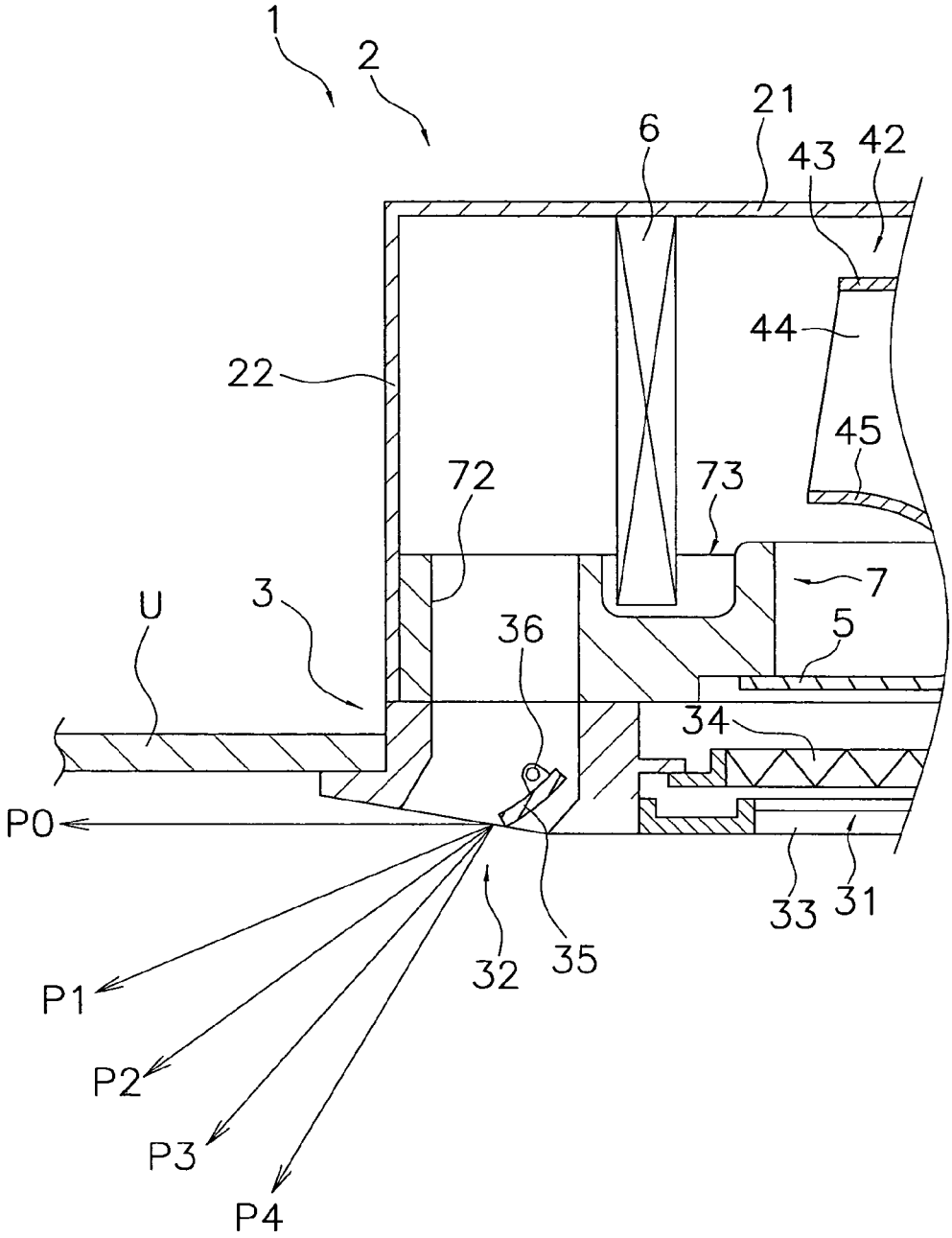
FIG. 4 is an enlarged view of the vicinity of the outlet.

As depicted in FIG. 1 through FIG. 4, each outlet 32 is provided with a louver 35 that serves as a guiding means capable of changing the blow-out vertical direction of the air conditioned air. Here, FIG. 4 is an enlarged view of FIG. 2 and depicts the vicinity of one of the outlets 32.

In the present embodiment, each louver 35 is a substantially rectangular blade member extending elongated in the longitudinal direction of each outlet 32. A linking pin 36 is provided at both end parts of the louver 35 in the longitudinal direction, and is supported by the face panel 3 so that it is oscillatable about its axis in the longitudinal direction of the outlet 32. Furthermore, adjoining linking pins 36 are mutually linked via a linking shaft 37 that serves as a link mechanism. In addition, the rotary shaft of a louver motor 38 is linked to one of the linking shafts 37. Thereby, if the louver motor 38 is driven, then the rotation is transmitted from the rotary shaft of the louver motor 38 to the linking shafts 37, and is further transmitted from the linking shafts 37 to the linking pins 36, thereby synchronously oscillating all four louvers 35.

Furthermore, the blow-out vertical direction of the air conditioned air blown from the outlets 32 out into the indoor space can be changed by the oscillation of the louvers 35. Specifically, the louvers 35 can be set to a swing state by continuously driving the louver motor 38, and to a fixed state that fixes the blow-out vertical direction of the air conditioned air. Namely, if set to the swing state, then louvers 35 continuously oscillate and change the blow-out vertical direction of the air conditioned air; additionally, if set to the fixed state, then the louvers 35 oscillate and are fixed at a desired wind direction position by the operation of a remote control 84, and the like, which is discussed later, and the blow-out vertical direction of the air conditioned air can thereby be set to a fixed direction. In the present embodiment, the louver motor 38 is a geared motor and is constituted so that the fixed angle and oscillating range of the louvers 35 can be set in accordance with the energized time of the louver motor 38.

Furthermore, in the present embodiment, the four louvers 35 are constituted so that they synchronously oscillate by being linked via the linking shafts 37; however, the present embodiment is not limited thereto and may be constituted so that each louver 35 oscillates separately, for example, if the four louvers 35 were each linked to the rotary shaft of a louver motor.

Figure 5:
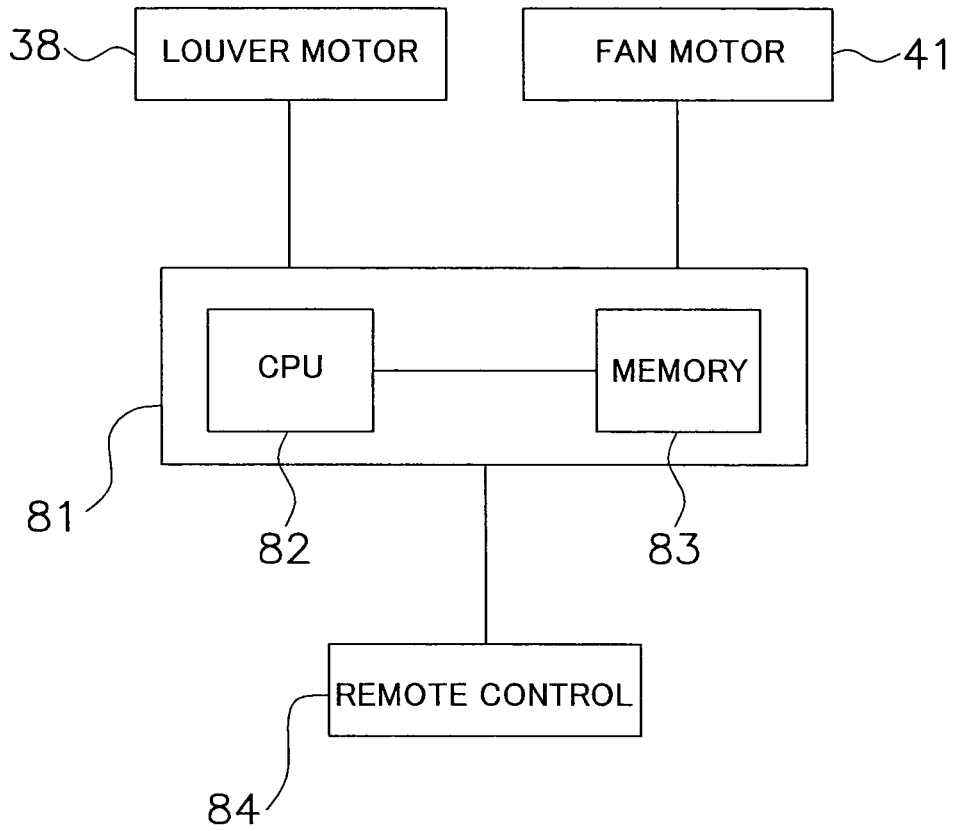
FIG. 5 is a schematic control block diagram of the air conditioner.

As depicted in FIG. 5, the air conditioner 1 further comprises a control device 81 for controlling the speed of the fan 4, the wind direction position of the louvers 35, and the like. Here, FIG. 5 is a schematic control block diagram of the air conditioner 1.

The control device 81 principally comprises a CPU 82 and a micro computer comprising memory 83. The control device 81 controls the speed of the fan 4, the wind direction position of the louvers 35, and the like, by inputting a control signal via the remote control 84, and, based on this signal, executing in the CPU 82 a control program stored in the memory 83, thereby operating the fan motor 41 of the fan 4, the louver motor 38 of the louvers 35, and the like.

Specifically, in the present embodiment, the wind direction position of the louvers 35 in the fixed state can be changed in five stages between a wind direction position P0 (a first blow-out direction) in the vicinity of the substantially horizontal direction with respect to the ceiling surface U and a wind direction position P4 (a second blow-out direction) more downward than the wind direction position P0 (i.e., the wind direction position P0, a wind direction position P1, a wind direction position P2, a wind direction position P3, and the wind direction position P4), as depicted in FIG. 4. In addition, in the present embodiment, the speed of the fan motor 41, i.e., the air volume of the fan 4, is changeable in three stages: an air volume H wherein the speed is greatest and the air volume is large; an air volume M wherein the speed is slightly lower than that of the air volume H and the air volume is medium; and an air volume L (a second air volume) wherein the speed is lowest and the air volume is small. Furthermore, the number of stages that the wind direction position of the louvers 35 and the air volume of the fan 4 can be changed in the fixed state may be greater or less than the number of stages in which they can be changed as above. In addition, the air volume of the fan 4 cannot be set via the remote control 84, but an air volume LL also exists wherein the air volume is smaller than the air volume L and is controllably set in cases such as when the air conditioner 1 is in standby operation.

(2) Operation of the Air Conditioner

The basic operation of the air conditioner 1 will first be explained.

When operation starts, the fan motor 41 is driven, rotating the impeller 42 of the fan 4. In addition, along with the driving of the fan motor 41, refrigerant is supplied from the outdoor unit (not shown) to the inside of the heat exchanger 6. Here, the heat exchanger 6 functions as an evaporator during cooling operation and as a condenser during heating operation. Further, attendant with the rotation of the impeller 42, the indoor air is sucked from the inlet 31 of the face panel 3 through the filter 34 and the bell mouth 5 into the casing 2 from the lower side of the fan 4. This sucked in indoor air is blown out to the outer circumferential side by the impeller 42, reaches the heat exchanger 6, is cooled or heated therein, and is then blown through the outlet holes 72 and the outlets 32 out toward the indoor space. In so doing, the air conditioned room is cooled or heated.

Incidentally, in a ceiling embedded type air conditioner 1 as in the present embodiment, if operation is performed in a state wherein the wind direction position of the louvers 35 is set to a position in the vicinity of substantially the horizontal direction with respect to the ceiling surface U, as in the wind direction position P0, then events such as the opening of a door or window, or a room occupant walking around, disturb the airflow distribution of the air conditioned space, and a phenomenon (hereinafter, referred to as the ceiling airflow clinging effect) may occur wherein the flow of the air conditioned air blown out from the outlets 32 unfortunately clings to the ceiling surface U. Accordingly, ceiling airflow clinging prevention control capable of preventing such a ceiling airflow clinging effect is incorporated in the control device 81 of the air conditioner 1 of the present embodiment.

Figure 6:
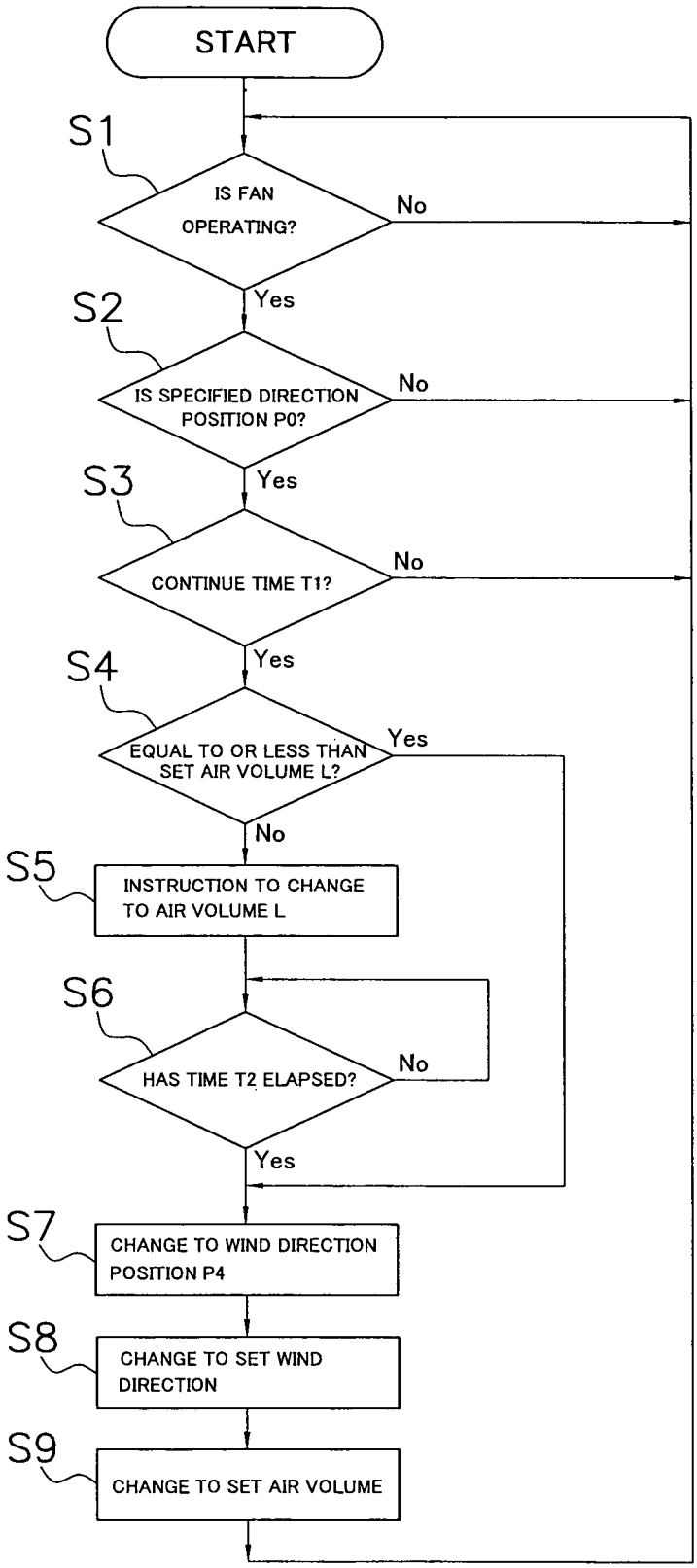
FIG. 6 is a flow chart of ceiling airflow clinging prevention control.

The following explains the operation of ceiling airflow clinging prevention control, referencing FIG. 6. Here, FIG. 6 is a flow chart of ceiling airflow clinging prevention control. Furthermore, the present embodiment explains the case of activating ceiling airflow clinging prevention control only in a state wherein the wind direction position of the louvers 35 is set to the wind direction position P0 (the first blow-out direction), which is the state that most easily produces the phenomenon in which the flow of the air conditioned air blown out from the outlets 32 unfortunately clings to the ceiling surface U.

In step S1, the method judges whether the fan 4 is in operation.

If the fan 4 is in operation, then, in step S2, the method judges whether the wind direction position of the louvers 35 is the wind direction position P0.

If the wind direction position of the louvers 35 is the wind direction position P0, then the method judges in step S3 whether that state has continued for a first prescribed (predetermined) time T1 or longer. At this time, the method judges whether that state has continued for the first prescribed time T1 or longer because if the wind direction position of the louvers 35 is changed to a wind direction position more downward than the wind direction position P0, then there is a possibility that there is no ceiling airflow clinging effect. In addition, in the present embodiment, the first prescribed time T1 is set to 30 minutes; it is set in this manner because if the time is set too long, then there is a risk that operation will continue for a long period of time in a state wherein the ceiling airflow clinging effect is produced; in addition, if the time is set too short, then the ceiling airflow clinging effect will tend not to occur, but, as discussed later, the wind direction position of the louvers 35 will be changed more downwardly than the wind direction position P0, regardless of whether the user sets the wind direction position of the louvers 35 to the wind direction position P0; therefore, setting the time empirically to approximately 30 minutes is appropriate.

Next, if the state wherein the wind direction position of the louvers 35 is the wind direction position P0 has continued for the first prescribed time T1 or longer, then, in step S4, the method judges whether the set air volume (the first air volume) of the fan 4 is equal to or less than air volume L. Here, the method judges whether the air volume of the fan 4 is equal to or less than the air volume L in order to determine whether control is being executed to lower the air volume of the fan 4 for the purpose of not imparting a feeling of a draft to the room occupants when changing the wind direction position of the louvers 35 downward, as discussed later, and whether the conditions of the set air volume require such control. Accordingly, in step S4, if the set air volume of the fan 4 is equal to or less than the air volume L, then steps S5, S6, which are discussed later, are skipped, and the method transitions to step S7.

Next, if the air volume of the fan 4 is greater than the air volume L (e.g., if the set air volume is the air volume M or the air volume H), then, in step S5, an instruction is issued to change the air volume of the fan 4 to the air volume L (the second air volume). Thereby, the air volume of the fan 4 can, in advance, begin to be reduced to the air volume L prior to performing control that changes the wind direction position of the louvers 35 downward, which is discussed later. Here, the air volume L is the lower limit of the air volume of the fan 4 settable by the user via the remote control 84, and is the air volume that tends not to impart a feeling of a draft to the room occupants.

Furthermore, after the instruction to change the air volume of the fan 4 to the air volume L, in step S6, the method judges whether a second prescribed (predetermined) time T2 has elapsed. At this point, the method judges whether the second prescribed time T2 has elapsed since the instruction in order to wait for the air volume of the fan 4 to transition to the air volume L. In addition, in the present embodiment, the second prescribed time T2 is set to 10 seconds; however, it is set in this manner in order to take into consideration, in a case wherein the air volume of the fan 4 is reduced to the air volume L from a state wherein the air volume of the fan 4 is the air volume H, which is the maximum air volume, the time from when the instruction to change that air volume was executed to the time when the speed of the fan 4 decreased to the air volume L. Consequently, after the instruction to change the air volume of the fan 4 to the air volume L, the air volume of the fan 4 is reliably reduced to the air volume L after the second prescribed time T2 has elapsed.

Next, if the second prescribed time T2 has elapsed, then, in step S7, the wind direction position of the louvers 35 is set to the wind direction position P4 (the second blow-out direction). In so doing, even if operation is performed in the state wherein the wind direction position of the louvers 35 is set to the wind direction position P0 and the ceiling airflow clinging effect arises, the flow of the air conditioned air blown out from the outlets 32 can be guided downward and detached from the ceiling surface U. Thereby, the time during which the ceiling airflow clinging effect is produced can be automatically reduced without manual operation by the user, and staining of the ceiling surface U can be reduced. Here, the wind direction position P4 is the lower limit of the wind direction position of the louvers 35 that can be set by the user via the remote control 84, and is the wind direction position at which the flow of the air conditioned air that produces the ceiling airflow clinging effect can be detached from the ceiling surface U.

Moreover, in steps S5, S6, the air volume of the fan 4 is reduced beforehand to the air volume L, and a feeling of a draft is not imparted to the room occupants when the wind direction position of the louvers 35 is changed from the wind direction position P0 to the wind direction position P4.

Furthermore, if the wind direction position of the louvers 35 is changed to the wind direction position P4, then, in step S8, the wind direction position of the louvers 35 is once again changed to the wind direction position P0 (the first blow-out direction). In other words, the wind direction position of the louvers 35 is temporarily changed in step S7 from the wind direction position P0 to the wind direction position P4, then returned once again to the wind direction position P0, thereby minimizing the time in which the air conditioned air blown out from the outlets 32 is blown out in a state wherein the wind direction position of the louvers 35 is the wind direction position P4. Consequently, the ceiling airflow clinging effect can be prevented while maximally maintaining the wind direction position of the louvers 35 set by the user at the wind direction position P0.

Next, after the wind direction position of the louvers 35 is changed from the wind direction position P4 to the wind direction position P0, in step S9, the air volume of the fan 4 is changed from the air volume L to the set air volume (the first air volume) for the case when the wind direction position of the louvers 35 is the wind direction position P0. In other words, the air volume of the fan 4 is changed to the air volume L prior to the wind direction position of the louvers 35 being changed temporarily from the wind direction position P0 to the wind direction position P4 in steps S5, S6, and is then changed once again to the set air volume (e.g., the air volume M or the air volume H) for the case when the wind direction position of the louvers 35 is the wind direction position P0, after the wind direction position of the louvers 35 is returned from the wind direction position P4 to the wind direction position P0; therefore, the air volume of the fan 4 does not increase during the time from the wind direction position P4 until returned to the wind direction position P0. Consequently, a feeling of a draft is not imparted to the room occupants.

Furthermore, if the set air volume of the fan 4 is the air volume L when the wind direction position of the louvers 35 is the wind direction position P0, then, in step S9, it is perfunctory set from the air volume L to the air volume L, but the air volume of the fan 4 does not change substantially.

The following explains the process for the case wherein the user has changed the setting of the wind direction position of the louvers 35 via the remote control 84 when the process from step S4 to step S9 is being performed. For example, if an instruction is given to change the setting to the wind direction position of the louvers 35 to the wind direction position P2 (a third blow-out direction) in the middle of executing control in step S7 to change the wind direction position of the louvers 35 from the wind direction position P0 (the first blow-out direction) to the wind direction position P4 (the second blow-out direction), then processing can be performed so that control to change the wind direction position of the louvers 35 from the wind direction position P0 to the wind direction position P4 is performed as is, and the wind direction position of the louvers 35 is changed in step S8 from the wind direction position P4 to the wind direction position P2 without changing it from the wind direction position P4 to the wind direction position P0.

In other words, even if an instruction were given to change the setting of the wind direction position of the louvers 35 during the time when the wind direction position of the louvers 35 is temporarily changed from the wind direction position P0 to the wind direction position P4 and then once again changed from the wind direction position P4 to the wind direction position P0, then it would go through the process of changing from the wind direction position P0 to the wind direction position P4; consequently, even if operation were performed in a state wherein the wind direction position of the louvers 35 was set to the wind direction position P0 and the ceiling airflow clinging effect arose, the flow of the air conditioned air blown out from the outlets 32 could be guided downward and detached from the ceiling surface U.

Moreover, after the wind direction position of the louvers 35 is changed from the wind direction position P0 to the wind direction position P4, the wind direction position of the louvers 35 is directly changed from the wind direction position P4 to the wind direction position P2 without changing from the wind direction position P4 to the wind direction position P0, and the responsiveness to changing the setting of the wind direction position of the louvers 35 can thereby be improved.

In addition, even if the user changes the setting of the air volume of the fan 4 via the remote control 84 when the process from step S4 to step S9 is being performed, a process the same as the abovementioned process is performed for the case wherein the setting of the wind direction position of the louvers 35 has changed. For example, if an instruction is issued to change the setting of the air volume of the fan 4 to the air volume M (a third air volume) in the middle of executing control in steps S5, S6 to change the air volume of the fan 4 from the set air volume (the first air volume, e.g., the air volume H), with the wind direction position of the louvers 35 at the wind direction position P0, to the air volume L (the second air volume), then processing can be executed so that the control to change the air volume of the fan 4 from the air volume H to the air volume L is performed as is, and the setting of the air volume of the fan 4 is changed from the air volume L to the air volume M without changing it from the air volume L to the air volume H.

In other words, even if an instruction is given to change the setting of the air volume of the fan 4 during the time when the wind direction position of the louvers 35 is temporarily changed from the wind direction position P0 to the wind direction position P4 and then once again changed from the wind direction position P4 to the wind direction position P0, then it goes through the process of changing the air volume of the fan 4 from the air volume H to the air volume L; consequently, a feeling of a draft is reliably not imparted to the room occupants.

Moreover, because the air volume of the fan 4 is changed from the air volume H to the air volume L and then directly changed from the air volume L to the air volume M without changing from the air volume L to the air volume H, the responsiveness to changing the setting of the air volume of the fan 4 can be improved.

Thus, even if the user changes the setting of the wind direction position of the louvers 35 or the air volume of the fan 4 via the remote control 84 when the process from step S4 to step S9 is being performed, it is possible to perform operation that guides the flow of the air conditioned air blown out from the outlets 32 downward and detaches it from the ceiling surface U, and to perform operation that reduces the air volume of the fan 4 so that a feeling of a draft is not imparted to the room occupants.

(3) Other Embodiments

The above explained an embodiment of the present invention based on the drawings, but the specific constitution is not limited to these embodiments, and it is understood that variations and modifications may be effected without departing from the spirit and scope of the invention.

(A)

In the abovementioned embodiment, when changing the wind direction position of the louvers 35 from the wind direction position P0 to the wind direction position P4, the air volume is changed in steps S4, S5 to the air volume L, which is the lower limit of the air volume that can be set by the user via the remote control 84; however, if the air conditioner 1 is in standby operation and the like, then it may be changed to the air volume LL, which is an air volume smaller than the air volume L that is controllably set.

(B)

In the abovementioned embodiment, after an instruction that changes the air volume of the fan 4, the method waits for the elapse of the second prescribed time T2 in step S6; however, if the response to the speed control of the fan 4 is fast, then the step S6 may be omitted because it is not necessary to wait for the elapse of the second prescribed time T2.

(C)

In the abovementioned embodiment, the condition of the wind direction position of the louvers 35 that activates ceiling airflow clinging prevention control was set only for the case wherein the wind direction position P0 state continued for the first prescribed time or longer; however, to further reliably prevent the ceiling airflow clinging effect, the condition may also be set for the case wherein the wind direction positions P0 and P1 states continue for the first prescribed time or longer.

(D)

In the abovementioned embodiment, the wind direction position of the louvers 35 is changed in step S7 from the wind direction position P0 downward to the wind direction position P4; however, if the ceiling airflow clinging effect can be prevented, then it may be changed from the wind direction position P0 downward to the wind direction position P3, which is upward of the wind direction position P4.

(E)

In the abovementioned embodiment, the present embodiment was applied to a four directional blow-out type ceiling embedded type air conditioner, but may also be applied to other ceiling embedded type air conditioners, such as a two directional blow-out type.

Industrial Field of Application

By using the present invention, it is possible with a ceiling embedded type air conditioner to prevent the unfortunate clinging to the ceiling surface of the flow of the air conditioned air blown out from the outlets due to disturbances to the airflow distribution of the air conditioned space, such as the opening of a door or window.

What is claimed is:

1. A ceiling embedded type air conditioner comprising:

a casing housing the air conditioner being embedded in a ceiling;

an outlet configured to blow out air conditioned air toward an indoor space;

a guiding member movably mounted with respect to said casing to change a blow-out vertical direction of the air conditioned air at said outlet; and a control device operatively controlling said guiding member between a plurality of fixed positions tier changing said blow-out vertical direction of the air conditioned air blown out from said outlet to said indoor space, said plurality of fixed positions including at least a first blow-out direction, a second blow-out direction and a third blow-out direction, said control device configured to perform a ceiling airflow clinging prevention control operation in which said control device gives a temporary blow-out direction changing instruction to said guiding member that temporarily changes said blow-out vertical direction of the air conditioned air from said first blow-out direction to said second blow-out direction only after determining said guide member has been in said first blow-out direction for a first predetermined time or longer, said second blow-out direction being a direction corresponding to one of said fixed positions at which said guiding member is more downward than said first blow-out direction, said first blow-out direction being a direction corresponding to an upper limit of said fixed positions at which said guiding member changes said blow-out vertical direction of the air conditioned air blown out from said outlet to said indoor space, said third blow-out direction being a direction corresponding to one of said fixed positions at which said blow-out vertical direction of the air conditioned air from said guiding member is between said first and second blow-out directions, said control device being further configured and arranged to give said temporary blow-out direction changing instruction based only on an amount of time said guide member has been in said first blow-out direction when said ceiling airflow clinging prevention control operation is performed, and said control device giving a blow-out direction user setting instruction to said guiding member to change from said second blow-out direction to said third blow-out direction without changing to said first blow-out direction in response to a user input command after said guiding member has temporarily changed said blow-out vertical direction of the air conditioned air from said first blow-out direction to said second blow-out direction, when said blow-out direction user setting instruction is given during a time when the blow-out vertical direction of the air conditioned air is in a process of being temporarily changed by said temporary blow-out direction changing instruction from said first blow-out direction to said second blow-out direction.

2. The ceiling embedded type air conditioner as recited in claim 1, wherein said second blow-out direction is a direction corresponding to a lower limit at which said guiding member changes said blow-out vertical direction of the air conditioned air blown out from said outlet to said indoor space.

3. The ceiling embedded type air conditioner as recited in claim 1, further comprising a fan being configured to suck in and blow out air, said control device further giving a temporary air volume changing instruction to said fan in response to said control device determining the guide member has been in said first blow-out direction for the first predetermined time or longer, said temporary air volume changing instruction temporarily changing an air volume of the air conditioned air from a first air volume to a second air volume that is smaller than said first air volume prior to said guide member being changed from said first blow-out direction to said second blow-out direction in response to said control device determining said guide member has been in said first blow-out direction for the first predetermined time or longer, and said control device further giving additional instructions to said guiding member that changes said blow-out vertical direction of the air conditioned air from said second blow-out direction to said first blow-out direction, and to the fan that changes the air volume of the air conditioned air from said second air volume to said first air volume in response to said guiding member reaching said first blow-out direction by executing said temporary blow-out direction changing instruction.

4. The ceiling embedded type air conditioner as recited in claim 3, wherein said second air volume corresponds to a lower limit of a variable air volume range of said air conditioned air.

5. The ceiling embedded air conditioner as recited in claim 3, wherein said control device gives an air volume user setting instruction to said fan to change the air volume of the air conditioned air from said second air volume to a third air volume without changing to said first air volume in response to a user input command after said fan has temporarily changed the air volume of the air conditioned air from said first air volume to said second air volume, when said air volume user setting instruction is given during a time when the blow-out vertical direction of the air conditioned air is in a process of being temporarily changed by said temporary blow-out direction changing instruction from said first blow-out direction to said second blow-out direction.

6. The ceiling embedded type air conditioner as recited in claim 3, wherein said first blow-out direction is a direction corresponding to an upper limit at which said guiding member changes said blow-out vertical direction of the air conditioned air blown out from said outlet to said indoor space.

7. The ceiling embedded type air conditioner as recited in claim 3, wherein said second blow-out direction is a direction corresponding to a lower limit at which said guiding member changes said blow-out vertical direction of the air conditioned air blown out from said outlet to said indoor space.

8. The ceiling embedded type air conditioner as recited in claim 3, wherein said control device gives a blow-out direction user setting instruction to said guiding member to change from said second blow-out direction to said third blow-out direction without changing to said first blow-out direction in response to a user input command after said guiding member has temporarily changed said blow-out vertical direction of the air conditioned air from said first blow-out direction to said second blow-out direction, when said blow-out direction user setting instruction is given during a time when the blow-out vertical direction of the air conditioned air is in a process of being temporarily changed by said temporary blow-out direction changing instruction from said first blow-out direction to said second blow-out direction.

9. A ceiling embedded type air conditioner, comprising:

a casing housing the air conditioner being embedded in a ceiling;

a fan being configured to suck in and blow out air;

an outlet configured to blow out air conditioned air toward an indoor space; and a guiding member movably mounted with respect to said casing to change a blow-out vertical direction of the air conditioned air at said outlet; and a control device operatively controlling said guiding member between a plurality of fixed positions for changing said blow-out vertical direction of the air conditioned air blown out from said outlet to said indoor space, said plurality of fixed positions including at least first blow-out direction and a second blow-out direction, said control device configured to perform a ceiling airflow clinging prevention control operation in which said control device gives a temporary air volume changing instruction to said fan that temporarily changes an air volume of the air conditioned air from a first air volume to a second air volume that is smaller than said first air volume after determining said guide member has been in said first blow-out direction for a first predetermined time or longer, said second blow-out direction being a direction corresponding to one of said fixed positions at which said guiding member is more downward than said first blow-out direction, said control device giving a temporary blow-out direction changing instruction to said guiding member that changes the blow-out vertical direction of the air conditioned air from said first blow-out direction to said second blow-out direction after said temporary air volume changing instruction to said fan is given by said control device to change said air volume from said first air volume to said second air volume and a second predetermined time has elapsed since giving said temporary air volume changing instruction when said ceiling airflow clinging prevention control operation is performed, and said control device giving a blow-out direction user setting instruction to said guiding member to change from said second blow-out direction to said third blow-out direction without changing to said first blow-out direction in response to a user input command after said guiding member has temporarily changed said blow-out vertical direction of the air conditioned air from said first blow-out direction to said second blow-out direction, when said blow-out direction user setting instruction is given during a time when the blow-out vertical direction of the air conditioned air is in a process of being temporarily changed by said temporary blow-out direction changing instruction from said first blow-out direction to said second blow-out direction.

10. The ceiling embedded type air conditioner as recited in claim 9, wherein said second air volume corresponds to a lower limit of a variable air volume range of said air conditioned air.

11. The ceiling embedded type air conditioner as recited in claim 9, wherein said control device gives an air volume user setting instruction to said fan to change the air volume of the air conditioned air from said second air volume to a third air volume without changing to said first air volume in response to a user input command after said fan has temporarily changed the air volume of the air conditioned air from said first air volume to said second air volume, when said air volume user setting instruction is given during a time when the blow-out vertical direction of the air conditioned air is in a process of being temporarily changed by said temporary blow-out direction changing instruction from said first blow-out direction to said second blow-out direction.

12. The ceiling embedded type air conditioner as recited in claim 9, wherein said first blow-out direction is a direction corresponding to an upper limit at which said guiding member changes said blow-out vertical direction of the air conditioned air blown out from said outlet to said indoor space.

13. The ceiling type air conditioner as recited in claim 9, wherein said second blow-out direction is a direction corresponding to a lower limit at which said guiding member changes said blow-out vertical direction of the air conditioned air blown out from said outlet to said indoor space.

14. The ceiling embedded type air conditioner as recited in claim 9, wherein said control device further gives a subsequent air volume changing instruction to said fan to change the air volume of the air conditioned air from said second air volume to said first air volume after said blow-out vertical direction of the air conditioned air has been changed by said guiding member from said second blow-out direction to said first blow-out direction.

15. The ceiling embedded type air conditioner as recited in claim 14, wherein said second air volume corresponds to a lower limit of a variable air volume range of said air conditioned air.

16. The ceiling embedded type air conditioner as recited in claim 14, wherein said control device gives an air volume user setting instruction to said fan to change the air volume of the air conditioned air from said second air volume to a third air volume without changing to said first air volume in response to a user input command after said fan has temporarily changed the air volume of the air conditioned air from said first air volume to said second air volume, when said air volume user setting instruction is given during a time when the blow-out vertical direction of the air conditioned air is in a process of being temporarily changed by said temporary blow-out direction changing instruction from said first blow-out direction to said second blow-out direction.

17. A method of controlling a ceiling embedded type air conditioner embedded in a ceiling surface comprising:

selectively controlling movement of a guiding member with respect to a casing of the air conditioner that is embedded in the ceiling surface between a plurality of fixed positions for changing a blow-out vertical direction of air conditioned air blown out from an outlet to an indoor space; and selectively controlling an air volume of a fan that blows out air via said outlet between a first air volume and a second air volume that is lower than said first air volume, said controlling of the movement of said guiding member including performing a ceiling airflow clinging prevention control operation in which said guiding member is set to change the blow-out vertical direction of the air conditioned air from a first blow-out direction to a second blow-out direction upon determining the air conditioned air is at said second air volume for a first predetermined time or longer, said second blow-out direction being more downward than said first blow-out direction, said controlling of the air volume of said fan when performing said ceiling airflow clinging prevention control operation including changing said air volume of the air conditioned air from said first air volume to said second air volume if the air conditioned air is at said first air volume and delaying said setting of said guiding member from said first blow-out direction to said second blow-out direction until after a second predetermined time has elapsed since said changing said first air volume to said second air volume, said controlling of the movement of said guiding member when performing said ceiling airflow clinging prevention control operation including changing the blow-out vertical direction of the air conditioned air back to said first blow-out direction from said second blow-out direction, said controlling of the air volume of said fan when performing said ceiling airflow clinging prevention control operation including changing said air volume of the air conditioned air from said second air volume to said first air volume after the changing of the blow-out vertical direction of the air conditioned air back to said first blow-out direction from said second blow-out direction, and said controlling of the movement of said guiding member including giving a blow-out direction user setting instruction to said guiding member to change from said second blow-out direction to said third blow-out direction without changing to said first blow-out direction in response to a user input command after said guiding member has temporarily changed said blow-out vertical direction of the air conditioned air from said first blow-out direction to said second blow-out direction, when said blow-out direction user setting instruction is given during a time when the blow-out vertical direction of the air conditioned air is in process of being temporarily changed by said temporary blow-out direction changing instruction from said first blow-out direction to said second blow-out direction.

18. A method of controlling a ceiling embedded type air conditioner embedded in a ceiling surface comprising:

selectively controlling movement of a guiding member with respect to a casing of the air conditioner that is embedded in the ceiling surface between a plurality of fixed positions for changing a blow-out vertical direction of the air conditioned air blown out from an outlet to an indoor space, said plurality of fixed positions including at least a first blow-out direction, a second blow-out direction and a third blow-out direction, with said third blow-out direction being a direction corresponding to one of said fixed positions at which said blow-out vertical direction of the air conditioned air from said guiding member is between said first and second blow-out directions; and selectively controlling an air volume of a fan that blows out air via said outlet between a first air volume and a second air volume that is lower than said first air volume, said controlling of the movement of said guiding member including performing a ceiling airflow clinging prevention control operation in which a temporary blow-out direction changing instruction. is given to said guiding member to change the blow-out vertical direction of the air conditioned air from a first blow-out direction to a second blow-out direction only after determining said guide member has been in said first blow-out direction for a first predetermined time or longer, said second blow-out direction being a direction corresponding to one of said fixed positions at which said guiding member is more downward than said first blow-out direction, said first blow-out direction being a direction corresponding to an upper limit of said fixed positions at which said guiding member changes said blow-out vertical direction of the air conditioned air blown out from said outlet to said indoor space, said controlling of the movement of said guiding member when performing said ceiling airflow clinging prevention control operation including changing the blow-out vertical direction of the air conditioned air back to said first blow-out direction from said second blow-out direction, giving said temporary blow-out direction changing instruction. being based only on an amount of time said guide member has been in said first blow-oft direction when said ceiling airflow clinging prevention control operation is performed, and said controlling of the movement of said guiding member including giving a blow-out direction user setting instruction to said guiding member to change from said second blow-out direction to said third blow-out direction without changing to said first blow-out direction in response to a user input command after said guiding member has temporarily changed said blow-out vertical direction of the air conditioned air from said first blow-out direction to said second blow-out direction, when said blow-out direction user setting instruction is given during a time when the blow-out vertical direction of the air conditioned air is in a process of being temporarily changed b said temporary blow-out direction changing instruction from said first blow-out direction to said second blow-out direction.

* * * * *